US007217893B1

(12) United States Patent
Huang et al.

(10) Patent No.: US 7,217,893 B1
(45) Date of Patent: May 15, 2007

(54) TWO-STAGE BUTTON STRUCTURE

(75) Inventors: Yu-Cheng Huang, Hsinchu (TW); Tzu-Chih Lin, Hsinchu (TW)

(73) Assignee: Altek Corporation, Hsinchu (TW)

( * ) Notice: Subject to any disclaimer, the term of this patent is extended or adjusted under 35 U.S.C. 154(b) by 0 days.

(21) Appl. No.: 11/580,089

(22) Filed: Oct. 13, 2006

(51) Int. Cl.
*H01H 13/48* (2006.01)

(52) U.S. Cl. ..... 200/1 B; 200/406; 200/516

(58) Field of Classification Search ..... 200/1 B, 200/406, 516, 517, 341, 520
See application file for complete search history.

(56) References Cited

U.S. PATENT DOCUMENTS 4,659,881 A * 4/1987 Dowe ..... 200/516
5,510,584 A * 4/1996 Norris ..... 200/1 B
6,303,887 B1 * 10/2001 Ando ..... 200/1 B
6,936,777 B1 * 8/2005 Kawakubo ..... 200/1 B
6,995,324 B2 * 2/2006 Asada ..... 200/1 B
7,157,650 B2 * 1/2007 Rochon ..... 200/1 B
7,166,813 B2 * 1/2007 Soma et al. ..... 200/341

* cited by examiner

*Primary Examiner*—Michael A. Friedhofer
(74) *Attorney, Agent, or Firm*—Rosenberg, Klein & Lee

(57) ABSTRACT

A two-stage button structure includes: a silver paste PCB, a metal dome, a film, a flexible contact body, and a button body. When the button body is pressed to a first stage, the pair of conductive blocks of the flexible contact body respectively passes through the pair of through holes of the film to respectively electrically contact the first and the second conductive areas in order to generate a first stage signal. When the button body is pressed to a second stage, the metal dome is pressed via the contact pin to touch the third conductive area and the pair of conductive blocks respectively electrically contact the first and the second conductive areas at the same time so that the second and the third conductive areas electrically connect with each other to generate a second stage signal.

10 Claims, 5 Drawing Sheets

TWO-STAGE BUTTON STRUCTURE

BACKGROUND OF THE INVENTION

1. Field of the Invention

The present invention relates to a button structure, and particularly relates to a two-stage button structure that has a two-stage signal output function.

2. Description of the Related Art

There are many methods for people to commemorate an occasion. One common way is by taking pictures, because any occasion such as travel, a celebration, an event, or any good time that deserves to be commemorated can be recorded via a camera. Moreover, it is convenient for users to transmit image data from a camera to an electronic device such as a computer for modifying the image data. In addition, the price of a digital camera has become increasingly cheaper, so the number of people using digital cameras increases day by day.

In general a shutter button with a focusing function has two-stage pressing functions. The first stage pressing function (pressing lightly) is for focusing and the second stage pressing function (pressing to the end) is for taking a picture. The known two-stage button structure includes: a PCB, a switch mounted on the PCB, and a button element disposed on the switch. In addition, the button element has a button body and a spring disposed under the button body.

Hence, the known two-stage button structure is composed of the PCB, the switch, and the button element that includes the button body and the spring. Therefore, the assembly of the known two-stage button structure involves too many parts and increases the overall cost of the camera. Moreover, the thickness of the combination of the PCB and the switch is large, so that the known two-stage button structure needs a larger design space.

SUMMARY OF THE INVENTION

The present invention provides a two-stage button structure. The two-stage button structure has a silver paste PCB and a metal dome for replacing the known thick PCB. The two-stage button structure also has a flexible rubber body and a button body combined together for achieving a two-stage pressing function.

Furthermore, because the two-stage button structure is composed of the silver paste PCB, the metal dome, the flexible rubber body, and the button body, its manufacture cost is cheaper than the prior art. In addition, the width of the combination of the silver paste PCB and the metal dome is thinner than the prior art, so the design space of the combination of the silver paste PCB and the metal dome can be smaller than that of the known combination of the PCB and the switch.

One aspect of the present invention is a two-stage button structure, comprising: a silver paste PCB, a metal dome, a flexible contact body, and a button body. The silver paste PCB has a first conductive area, a second conductive area and a third conductive area that are separated from each other and are sequentially formed thereon from inside to outside. The metal dome is electrically disposed on the second conductive area, and is insulated from the third conductive area.

Moreover, the film is disposed on the silver paste PCB and is covered on the metal dome. The film has a pair of through holes for respectively exposing one part of the first conductive area and one part of the second conductive area. The flexible contact body has an opening, and a pair of conductive blocks projected downwardly therefrom and corresponding to the pair of through holes. The button body has a pressing portion and a contact pin extending downwardly from the pressing portion. The button body is disposed on the flexible contact body and the contact pin passes through the opening.

Whereby, when the button body is pressed to the first stage, the pair of conductive blocks of the flexible contact body respectively pass through the pair of through holes of the film to respectively electrically contact the first and the second conductive areas for generating a first stage signal. When the button body is pressed to the second stage, the metal dome is pressed via the contact pin to touch the third conductive area and the pair of conductive blocks respectively electrically contact the first and the second conductive areas at the same time so that the second and the third conductive areas electrically connect each other to generate a second stage signal.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF PREFERRED BEST MOLDS

Figure 1:
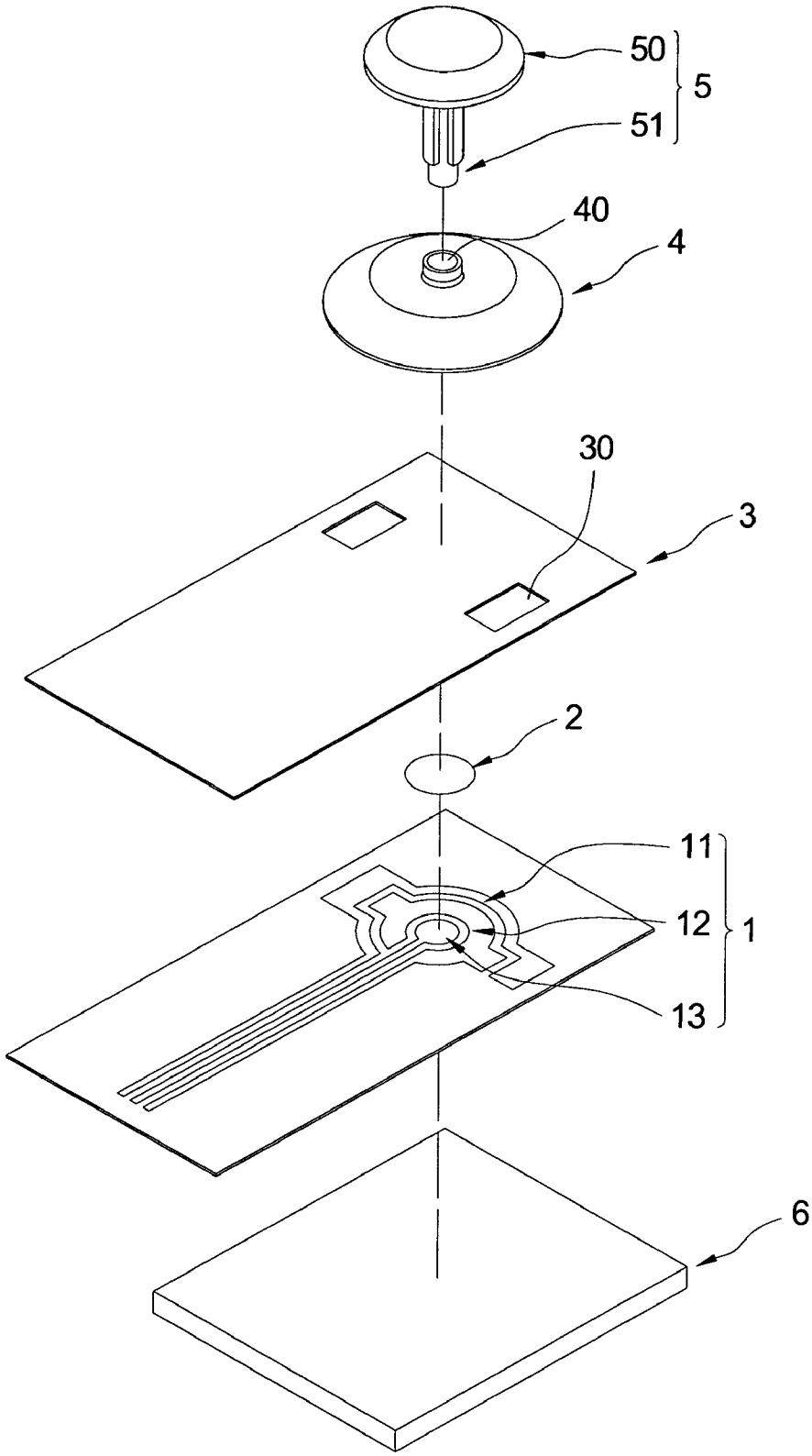
FIG. 1 is a perspective, exposed view of a two-stage button structure according to the present invention.
Figure 2:
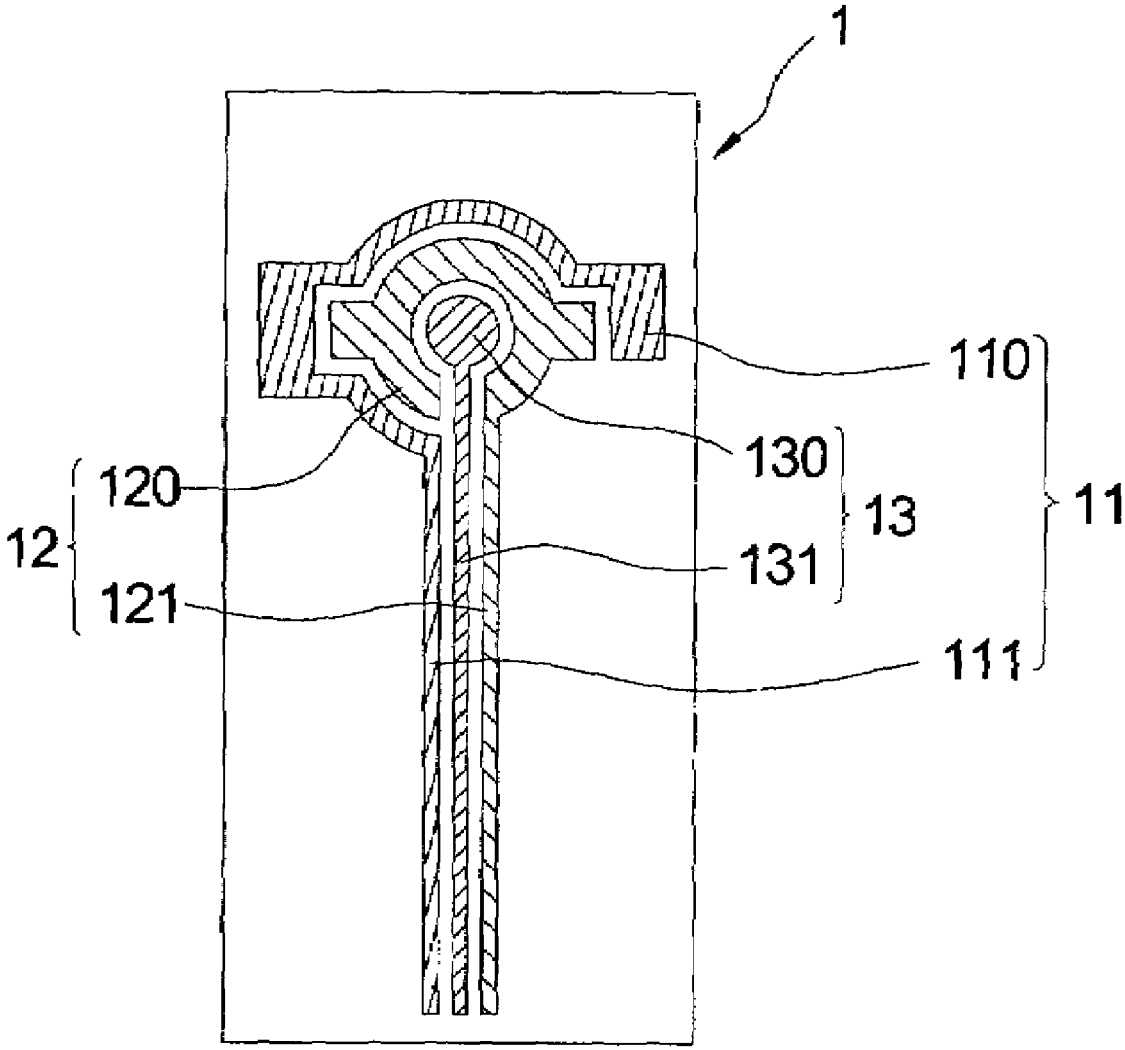
FIG. 2 is a top view of a silver paste PCB of a two-stage button structure according to the present invention.

Referring to FIGS. 1 and 2, the present invention provides a two-stage button structure comprising: a silver paste PCB 1, a metal dome 2, a film 3, a flexible contact body 4, a button body 5, and a frame 6 that is disposed under the silver paste PCB 1.

The silver paste PCB 1 has a first conductive area 11, a second conductive area 12 and a third conductive area 13 that are separated from each other and are sequentially formed thereon from inside to outside. The third conductive area 13 has a circular area 130 formed under the metal dome 2, and a third striped area 131 connected with the circular area 130. Moreover, the second conductive area 12 has a second surrounding area 120 formed along the circular area 130, and a second striped area 121 connected with the second surrounding area 120 and formed along one side of the third stripe 131. In addition, the first conductive area 11 has a first surrounding area 110 formed along the second surrounding area 120, and a first striped area 111 connected with the first surrounding area 110 and formed along another side of the third stripe 131.

The metal dome 2 is electrically disposed on the second conductive area 12 and is insulated from the third conductive area 13. The film 3 is disposed on the silver paste PCB 1 and is covered on the metal dome 2. The film 3 has a pair of through holes 30 for respectively exposing one part of the first conductive area 11 and one part of the second conductive area 12.

The flexible contact body 4 has an opening 40, and a pair of conductive blocks 41 projected downwardly therefrom and corresponding to the pair of through holes 30. The flexible contact body 4 can be made of rubber or any flexible material. Hence, the pair of conductive blocks 41 can be a pair of conductive rubbers. The flexible contact body 4 has a first deformed area 42 and a second deformed area 43 formed on the first deformed area 42. The first deformed area 42 has a thickness smaller than that of the second deformed area 43. In other words; the loading capability of the first deformed area 42 is smaller than that of the second deformed area 43. Hence, the first deformed area 42 is deformed easier than the second deformed area 43. Therefore, when the flexible contact body 4 bears pressure, the first deformed area 42 will be the first to become deformed.

The button body 5 has a pressing portion 50 and a contact pin 51 extending downwardly from the pressing portion 50. The button body 5 is disposed on the flexible contact body 4 and the contact pin 51 passes through the opening 40. In addition, a level position of the contact pin 51 is higher than that of the pair of conductive blocks 41.

Figure 3:
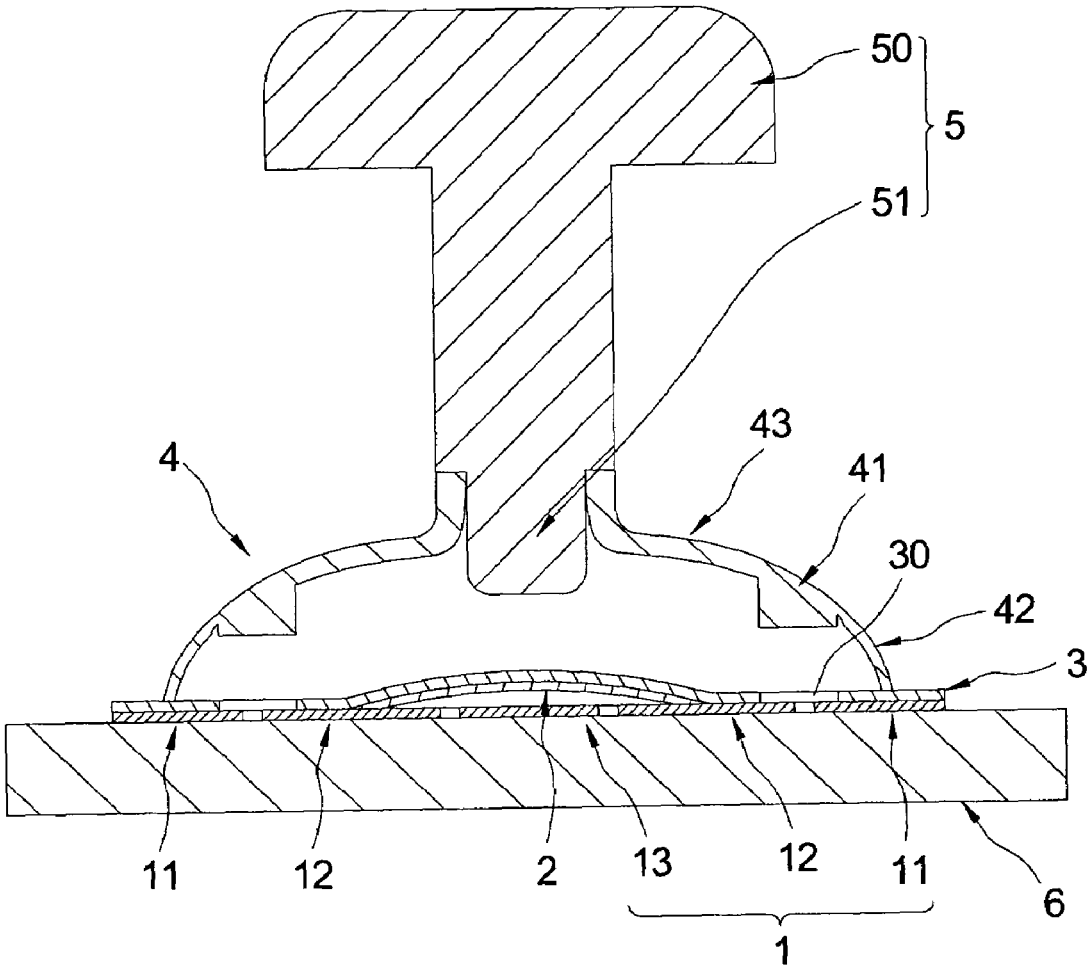
FIG. 3 is a side, cross-sectional view of a two-stage button structure (before the two-stage button structure is pressed) according to the present invention.
Figure 4:
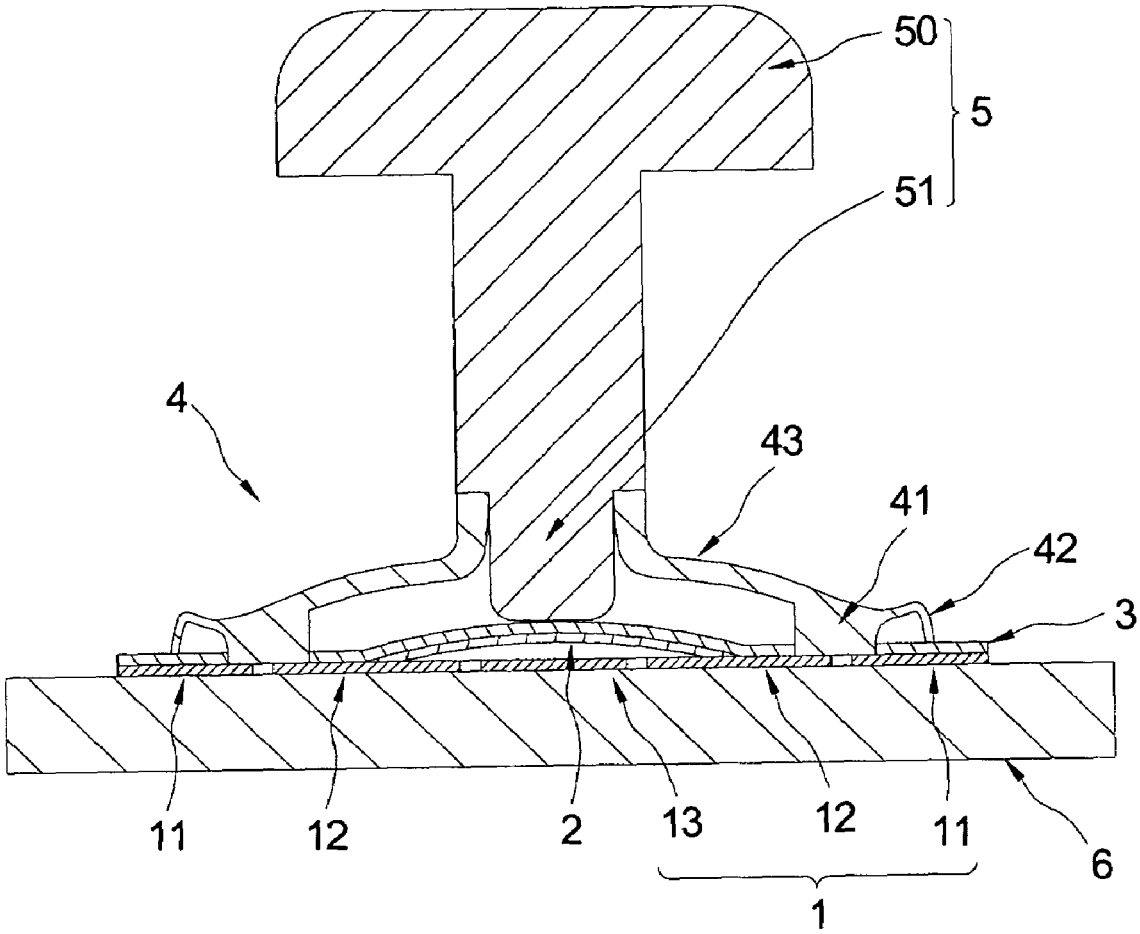
FIG. 4 is a side, cross-sectional view of a two-stage button structure (when the two-stage button structure is pressed to a first stage) according to the present invention.
Figure 5:
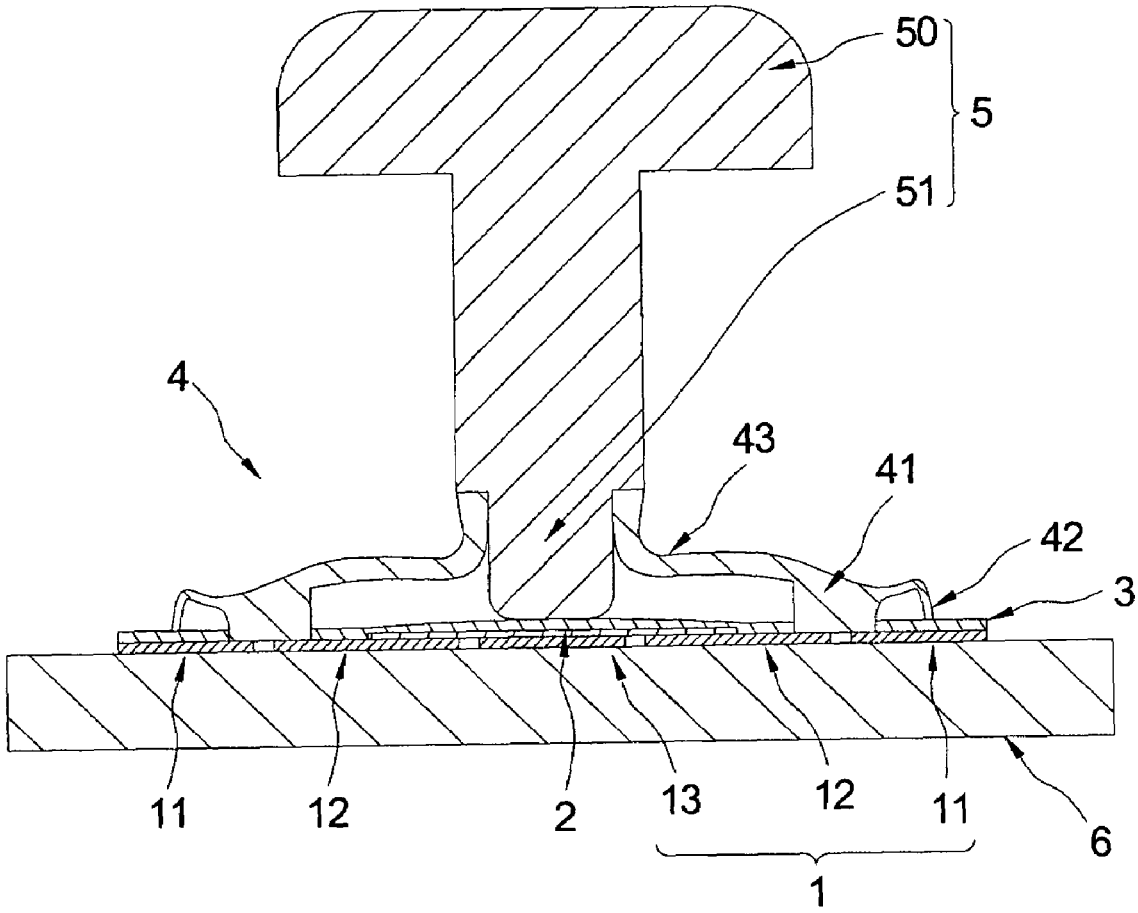
FIG. 5 is a side, cross-sectional view of a two-stage button structure (when the two-stage button structure is pressed to a second stage) according to the present invention.

Referring to FIGS. 3–5, before the button body 5 is pressed, the first, the second and the third conductive areas 11, 12, 13 are insulate from each other.

When the button body 5 is pressed to a first stage (as shown in FIG. 4), the pair of conductive blocks 41 of the flexible contact body 4 respectively pass through the pair of through holes 30 of the film 3 to respectively electrically contact the first conductive area 11 and the second conductive area 12 for generating a first stage signal.

When the button body 5 is pressed to a second stage (as shown in FIG. 5), the metal dome 5 is pressed via the contact pin 51 to touch the third conductive area 13 and the pair of conductive blocks 41 respectively electrically contact the first conductive area 11 and the second conductive area 12 at the same time (meaning that the first conductive area 11 and the second conductive area 12 maintain electrical contact) so that the second conductive area 12 and the third conductive area 13 electrically connect each other to generate a second stage signal.

In conclusion, the combination of the silver paste PCB 1 and the metal dome 2 is used to replace the known thick PCB. Moreover, the flexible contact body 4 (flexible rubber body) and the button body 5 are combined together for achieving a two-stage pressing function.

Furthermore, because the two-stage button structure is composed of the silver paste PCB 1, the metal dome 2, the flexible contact body 4, and the button body 5, its manufacturing cost is cheap. The width of the combination of the silver paste PCB 1 and the metal dome 2 is thin, so that the design space of the combination of the silver paste PCB 1 and the metal dome 2 is less than that of the known combination of the PCB and the switch.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A two-stage button structure, comprising:

a silver paste PCB having a first conductive area, a second conductive area and a third conductive area that are separated from each other and are sequentially formed thereon from outside to inside;

a metal dome electrically disposed on the second conductive area, and insulated from the third conductive area;

a film disposed on the silver paste PCB and covered on the metal dome, wherein the film has a pair of through holes for respectively exposing one part of the first conductive area and one part of the second conductive area;

a flexible contact body having an opening, and a pair of conductive blocks projected downwardly therefrom and corresponding to the pair of through holes; and a button body having a pressing portion and a contact pin extending downwardly from the pressing portion, wherein the button body is disposed on the flexible contact body and the contact pin passes through the opening;

whereby, when the button body is pressed to a first stage, the pair of conductive blocks of the flexible contact body respectively pass through the pair of through holes of the film to respectively electrically contact the first and the second conductive areas for generating a first stage signal; when the button body is pressed to a second stage, the metal dome is pressed via the contact pin to touch the third conductive area and the pair of conductive blocks respectively electrically contact the first and the second conductive areas at the same time so that the second and the third conductive areas electrically connect with each other to generate a second stage signal.

2. The two-stage button structure as claimed in claim 1, further comprising a frame disposed under the silver paste PCB.

3. The two-stage button structure as claimed in claim 1, wherein the third conductive area has a circular area formed under the metal dome, and a third striped area connected with the circular area.

4. The two-stage button structure as claimed in claim 3, wherein the second conductive area has a second surrounding area formed along the circular area, and a second striped area connected with the second surrounding area and formed along one side of the third stripe.

5. The two-stage button structure as claimed in claim 4, wherein the first conductive area has a first surrounding area formed along the second surrounding area, and a first striped area connected with the first surrounding area and formed along another side of the third stripe.

6. The two-stage button structure as claimed in claim 1, wherein the flexible contact body has a first deformed area and a second deformed area formed on the first deformed area.

7. The two-stage button structure as claimed in claim 6, wherein the first deformed area has a thickness smaller than that of the second deformed area.

8. The two-stage button structure as claimed in claim 1, wherein the flexible contact body is made of rubber.

9. The two-stage button structure as claimed in claim 1, wherein the pair of conductive blocks is a pair of conductive rubbers.

10. The two-stage button structure as claimed in claim 1, wherein a level position of the contact pin is higher than that of the pair of conductive blocks.

* * * * *